US005466882A

United States Patent [19]

Lee

[11] Patent Number: 5,466,882

[45] Date of Patent: * Nov. 14, 1995

[54] METHOD AND APPARATUS FOR PRODUCING AN ELECTRONIC REPRESENTATION OF A MUSICAL SOUND USING EXTENDED COERCED HARMONICS

[75] Inventor: J. Robert Lee, San Diego, Calif.

[73] Assignee: Gulbransen, Inc., San Diego, Calif.

[ * ] Notice: The portion of the term of this patent subsequent to Mar. 23, 2010, has been disclaimed.

[21] Appl. No.: 179,923

[22] Filed: Jan. 11, 1994

Related U.S. Application Data

[63] Continuation-in-part of Ser. No. 34,527, Mar. 22, 1993, abandoned, which is a continuation of Ser. No. 633,475, Dec. 20, 1990, Pat. No. 5,196,639.

[51] Int. Cl.[6] ..... G10H 1/057; G10H 7/08

[52] U.S. Cl. ..... 84/603; 84/607; 84/627

[58] Field of Search ..... 84/601–608, 622–625, 84/627

[56] References Cited

U.S. PATENT DOCUMENTS 5,196,639 3/1993 Lee et al. ..... 84/603

*Primary Examiner*—Stanley J. Witkowski

*Attorney, Agent, or Firm*—Baker, Maxham, Jester & Meador

[57] ABSTRACT

A technique for digitally processing a counterpart of a musical sound first transforms a set of time-domain samples of the sound into frequency-domain counterparts, gradually coerces the frequency-domain counterparts into integer multiples of a fundamental frequency of the sound, and then, in each of a plurality of amplitude transition portions, gradually changes the amplitudes of the frequency-domain counterparts from the beginning to the end of each amplitude transition portion.

9 Claims, 6 Drawing Sheets

METHOD AND APPARATUS FOR PRODUCING AN ELECTRONIC REPRESENTATION OF A MUSICAL SOUND USING EXTENDED COERCED HARMONICS

This is a continuation-in-part of application Ser. No. 08/034,527, filed Mar. 22,1993, and now abandoned which was a continuation of U.S. patent application Ser. No. 07/633,475, filed Dec. 20, 1990 (now U.S. Pat. No. 5,196,639).

This invention concerns the production and storage of electronic counterparts of musical sounds, and particularly relates to a technique for producing such a counterpart by forcing components of a quasi-periodic representation of a musical sound to be integer multiples of a fundamental frequency of the musical sound.

Specifically, the technique represented in this application concerns a frequency-domain technique in which the component frequencies of a digitally-sampled audio signal are gradually changed into integer ratios to the fundamental frequency of the audio signal. Following coercion of the component frequencies, higher harmonics of the fundamental frequency are allowed to decay, as they naturally would, in short bursts.

In the music industry, re-creation or synthesis of the sound of a traditional acoustic instrument is effected through a process referred to a sampling or pulse-code modulation synthesis. In this process, the should is represented by an analog waveform. The waveform is time-sampled and the samples are stored in a sequence which is a "counterpart" of the sound. Strictly speaking, a sample is a value that represents the instantaneous amplitude of the subject waveform at a specific point in time. A digital recording of the waveform consists of a sequence of digitally-represented amplitude values sampled at evenly spaced intervals of time. Relatedly, in the music industry, the term "sample" sometimes refers to the sequence of samples which comprise a digital recording. Such a digital recording is not unlike the recording that would be captured with a magnetic tape recorder, except that it could be stored in digital memory and, therefore, can be randomly accessed for synthesis of the recorded sound.

The synthesizer that plays back the digitally-recorded sound is not necessarily the device which recorded the sound in the first place. Presently, few instruments have both record and play capabilities. Most of the musical instruments that employ Sampling as a synthesis method use recordings that have been professionally processed, having undergone considerable reshaping before being provided in any electronic musical instrument. Some of the reshaping is done to enhance and clean the recorded sound, but the principal reason for processing the sound is to reduce the amount of memory space required for its storage.

In the description which follows, the terms "recording" and "storage" may be used synonymously. In this regard, the "recording" of a sound for playback may also mean the "storage" of a digital counterpart of the sound in a storage device, where the counterpart consists of a sequence of digital samples.

To reduce the length of recording, or the amount of storage required for musical sound, the most common form of processing used with sampling is looping, or one of its well-known variations. In looping, a synthesizer plays an original recording of the musical sound up to a designated time point, whereafter it repeatedly plays a short sequence of samples that describe one or more periods of the temporally-varying waveform; this sequence is called a "loop". Because the spectrum of the recorded waveform is temporally varying, it is usually difficult to match the end of a loop with its beginning without creating an audible "click" or "pop" at the point where the end and beginning are spliced together. The process is an empirical one requiring a great deal of time and a fair amount of fortune. This is especially true if several different loops are to be used during the life of a re-synthesized note.

In an effort to make looping easier and to attenuate or eliminate the click at the splice point, many synthesizers employ a method known as cross-fade looping. In this technique, the sound at the end of the loop is gradually blended in with the beginning of the loop, thus eliminating the click. This is done by continuously attenuating the amplitude of the end of the loop while raising the amplitude at the beginning of the loop essentially "fading out" the loop tail while "fading in" the head of the loop. The fade out/fade in gives rise to the name "cross fading". However, the end and the beginning of the loop are still discontinuous although the change from the tail to the head of the loop is less abrupt. Nevertheless, the change in spectrum from the beginning to the end of the loop, both in the amplitude and phase relationships of the component frequencies is pronounced and results in an audible distortion at the cross-over point.

If musical sound could be represented with periodic waveforms, a very efficient loop could be constructed for the electronic representation of the musical sound. In this respect, a periodic waveform is one whose component frequencies have integer ratios with the waveform's fundamental frequency and thus are true harmonics of that frequency. A loop for a periodic waveform requires only the storage and-continual cycling of a sequence of samples representing a single period of the waveform. Generation of a musical sound from such a loop will evidence no click and no audible transition because phase, frequency, and amplitude components exhibit spectral continuities between the beginning and the end of the loop. However, very few musical sounds are truly periodic. The only sounds that can be successfully looped are those that are nearly periodic or at least quasi-periodic; that is, sounds in which each period of the time-variant waveform is similar to its predecessor. Quasi-periodicity excludes most percussive sounds, but includes sounds with nearly periodic portions such as those produced by brass instruments, reeds and bowed strings. Pianos and orchestral bells also produce quasi-periodic sounds.

The design of an electronic device to synthesize a sound produced by a musical instrument is greatly aided if the sound is nearly periodic or quasi-periodic. In this regard, it is well-known that the Fourier transform can be used to convert a sequence of samples from a time-domain representation to a frequency-domain counterpart, and then convert them back again without any signal degradation. It is also commonly known that the most important identifying cues of recorded sound occur during an initial portion of the sound. For example, a musical sound (a "note") produced by striking the key of a piano includes an initial portion called the "attack" portion during which particular spectral characteristics identify the note. This is especially true of quasi-periodic sounds that quickly decay in amplitude after an initial burst of energy.

As is further known, after the initial attack portion of a naturally produced note, when the harmonic components are relatively stable in frequency, the note exhibits a decay portion in which the amplitudes of the higher harmonics attenuate quickly, while the lower harmonics attenuate rather more slowly. Electronic synthesis of the note by provision of a single cross-faded loop deletes the differential decay of harmonic amplitudes and gives the synthesized note a static quality, even when the synthesized note is decayed by uniform attenuation of the component frequencies.

In the electronic synthesis of a piano note, the note is recorded, processed, and then stored in an-electronic memory. The stored memory is placed in a musical synthesizer and is used to reproduce the note when an associated key is selected. For quasi-periodic and periodic notes with short initial attacks, a great deal of the electronic memory devoted to storage of the note can be eliminated if the loop portion of the stored representation occurs as soon as possible after the attack portion. For playback in a synthesizer, an amplitude envelope that approximates the decay of the original recording can then be imposed upon the loop portion of the stored reproduction. As stated above, the difficulty that arises with traditional looping is the mismatch of the frequency, amplitude, and phase components of the stored reproduction as the loop point is traversed and when the loop is played.

Therefore, the prior art of musical sound reproduction still suffers from the significant problem of deviation from an acceptable replica of the original sound. In addition, the prior art processing techniques which replicate the original sound in a stored reproduction result in a need for significant amount of semiconductor memory space for storage of the reproduction.

SUMMARY OF THE INVENTION

The primary objective of this invention is to produce a stored electronic counterpart of a musical sound which employs the looping method to reduce the amount of storage required, which eliminates the audible distortion produced by the splicing and cross-fade looping techniques, and which also reproduces the natural decay of a note.

A significant advantage which accompanies the achievement of the objective is the elimination of processing circuitry required to implement cross-fading in the prior art and the minimization of memory required to store the attack and decay portions of synthesized notes.

The achievement of this objective and other objectives is embodied in an invention based upon the inventors' critical observation that in a transition between the attack and loop portions of a recorded counterpart of a musical sound, the frequencies of spectral components of the sound can be manipulated and changed to be substantially integral multiples of the fundamental frequency of the musical sound. By the beginning of a first loop, all of the spectral components will then be true harmonics of the fundamental frequency. Significantly, a waveform representation of the musical sound in the first loop portion will constitute exactly one cycle of a periodic waveform so that the beginning and end of the loop period will match in frequency, amplitude, and phase. The result is the elimination of the distortion which would result if the loop were constricted according to the prior art techniques.

Next, the harmonics (integer multiples) of the fundamental frequency are processed to reproduce the decay which they exhibit in their natural environment. This is done in the invention by short bursts following the first loop. At the end of each burst, a single-cycle loop is provided. Between each loop, harmonic amplitudes are selectively Varied to reproduce the effect of natural decay.

The invention is practiced by first defining a harmonic transition portion between the attack and first loop portions of a musical sound's waveform. The sequence of samples derived from the waveform is converted from the time to the frequency domain. During the transition portion, the frequency of each spectral component produced by the conversion is gradually manipulated so as to coerce the frequency into an integer ratio to the fundamental frequency by the time that a first loop point is reached. From that point, the frequencies and amplitudes remain constant throughout the first loop.

Next, maintaining the coerced harmonics, the sound is converted to a series of amplitude transition/loop bursts. In each amplitude transition, the amplitude of each of one or more harmonics is varied until the following loop, when harmonics and amplitudes are maintained. A final loop ends the sequence.

After manipulation of the frequencies and amplitudes in the transitions, the sequence is converted back to the time domain to produce a counterpart of the musical sound which is then stored in a memory device. The memory device then can be employed in an electronic instrument to synthesize the musical sound represented by the time-domain waveform stored in the device.

DESCRIPTION OF THE PREFERRED EMBODIMENTS

In the invention, an audio signal, produced by a source musical instrument, is digitally recorded. The digital recording is a sequence of samples in time, with each sample representing the amplitude of the waveform representing the audio signal at a particular point in time. It is known in the prior art to partition the waveform into attack and loop portions and to capture in electronic memory portions of the sequence of samples so that the sequence can be read out of memory, amplified, and audibly played back to re-create the original audio signal.

Figure 1:
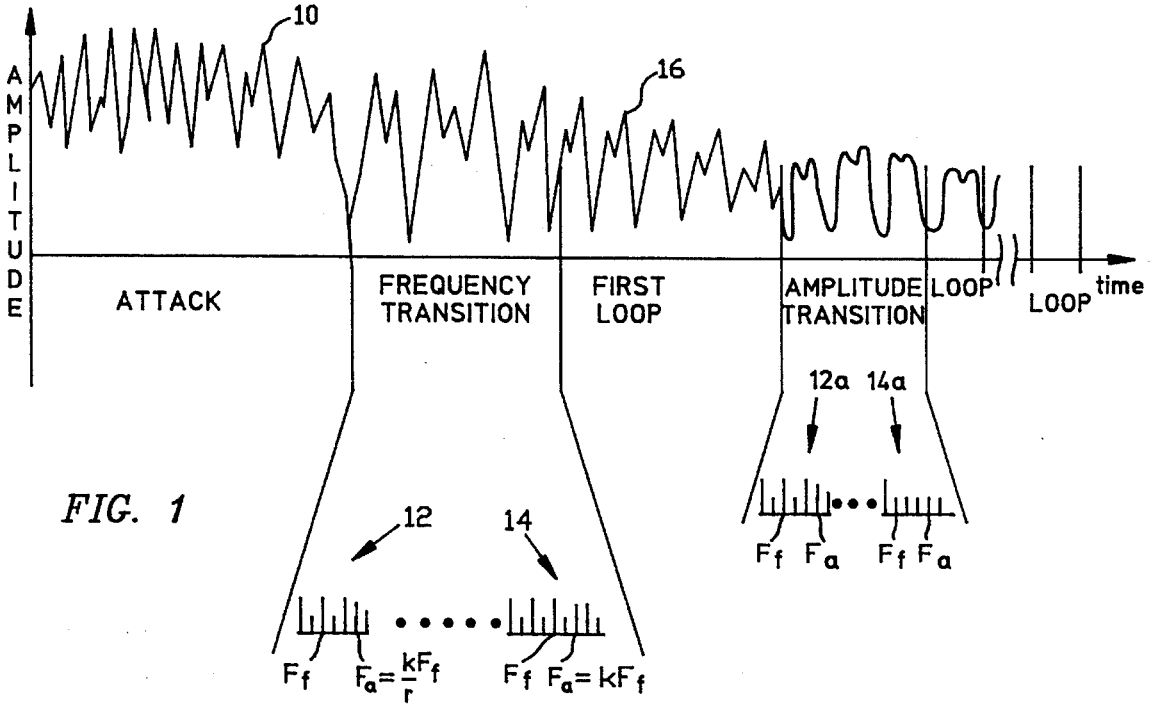
FIG. 1 illustrates a continuous, time-domain representation of a waveform which corresponds to a musical sound produced by a musical instrument and shows a multipartite partition of the waveform according to the invention.

FIG. 1 illustrates the waveform representation of an audio signal 10 and shows the partition of that signal into a plurality of portions: attack, frequency transition, and first loop followed by a plurality of amplitude transition and loop bursts. As shown, in the attack portion of the waveform 10, the signal displays wild, aperiodic fluctuations of amplitude. In the frequency transition portion of the waveform, the extremes in the fluctuations of the attack portion have attenuated; however, the waveform still exhibits a marked, though decreasing, non-periodicity. In the first loop portion of the waveform, the fluctuations of the attack and transition portions have significantly subsided and the waveform has assumed a somewhat periodic ("quasi-periodic") form. Following the first loop portion, the waveform is divided into a plurality of amplitude transition/loop bursts. These represent a decay portion of the audio signal during which the harmonic components are relatively stable with respect to frequency, but during which the amplitudes of different harmonics decay at different rates. It is asserted that the waveform of FIG. 1 illustrates an audible signal produced by a musical instrument, for example by striking the key of a piano. It is asserted that such a musical sound is characterized in having a "fundamental frequency" such as the sound middle C produced by striking the middle C key on a piano.

According to the invention, the frequencies of the waveform components in the frequency transition portion of the waveform of FIG. 1 are manipulated by a continuous process spanning the frequency transition period so that frequencies which may be rational multiples of fundamental frequency are changed to be integer multiples of the fundamental frequency by the beginning of the first loop portion. This is illustrated by the frequency-domain plots 12 and 14.

The frequency-domain plot 12 illustrates the frequency components of the waveform 10 at the beginning of the frequency transition portion. At this point, the fundamental frequency of the waveform is denoted by $F_f$, while another frequency component $F_a$ is shown as a multiple of the fundamental frequency. In this regard, frequency component $F_a$ is shown as the product of the rational number k/r (where k and r are integers) and the fundamental frequency $F_f$. By the end of the frequency transition portion, processing according to the invention has changed the frequency component $F_a$ to an integer multiple of the fundamental frequency $F_f$.

In the portion of the waveform following the first loop, the natural decay portion of the audible signal is reproduced by preparing multiple loops and moving from each loop to a subsequent loop through an amplitude transition region during which the amplitudes of harmonics may be individually changed. In the invention, the change is smooth, eliminating audible "clicks" caused by discontinuities in the harmonic amplitudes. For example, in FIG. 1, at an end of the first loop, the coerced harmonics have the relative amplitudes shown in plot 12*a*. During the amplitudes transition period from the first loop to the second loop ($L_2$) the amplitudes, but not the frequencies of the harmonics have been continuously reduced during the transition to the relative amplitudes shown in plot 12*b*. In each amplitude transition portion, a sequence of samples is provided to fill in the discontinuities in harmonic amplitudes by allowing decay of the harmonics from the amplitudes in the first loop to the amplitudes of the following loop.

The significance of the frequency transition is that with processing of the principal frequency components of the waveform 10 according to the invention, these components will be integer multiples of the fundamental frequency by the beginning of the first loop portion. Thus, the frequency components will be true harmonics of the fundamental frequency. Relatedly and importantly, the waveform 10 can then be represented in all of the loop portions as a truly periodic waveform. Thus, each of the loop portion of the waveform 10 following can be represented in electronic storage by a single period of the waveform. Furthermore, because the period represents a truly periodic waveform, a constant repetition of the single stored period will present no distortion when transitioning from the end back to the beginning of the loop. Thus, the audible artifacts in the loop portions of prior art synthesized sounds are eliminated.

Further, since the amplitude transitions following the first loop change the harmonic amplitudes continuously, audible artifacts resulting form amplitude discontinuities are avoided.

Figure 2:
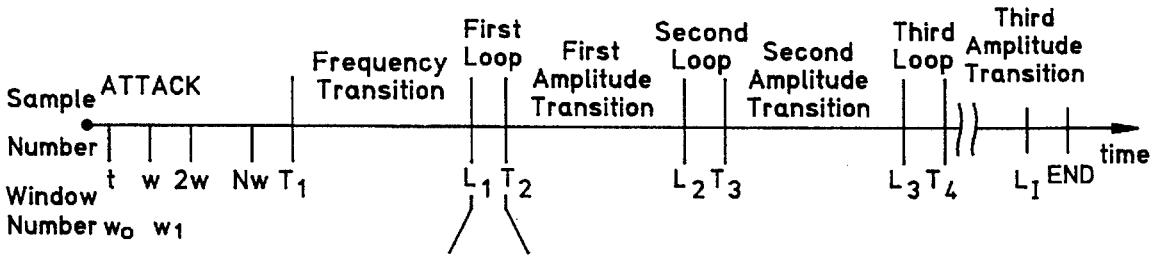
FIG. 2 is a linear mapping of the partitioning of the waveform of Figure I into sets of time-domain samples.

As is known, the waveform of FIG. 1 is captured for electronic storage in the form of a sequence of discrete samples of the amplitude of the waveform taken along the time line in FIG. 1. FIG. 2 represents such storage of the waveform as a sequence of N samples. FIG. 2 is intended to convey how the sequence of the samples is partitioned according to the invention. The illustration shows only sample locations, but does not show the samples themselves. In this regard, the sample sequence extends from sample 1 to sample N. The attack portion of the sequence includes the first T samples, with the Tth sample being the first sample in the transition portion. Sample L is the first sample in the loop portion of the waveform. According to the invention, the sequence of samples in FIG. 2 is further partitioned into a sequence of sample sets, each sample set containing exactly W samples. These sets are termed "windows" and each window has a window number. For example, the first W samples (that is, samples 1 through W) form window $w_0$.

During the frequency transition, the invention moves the frequencies of the overtones to be integer multiples of the fundamental frequency. All sound that follows the end of the frequency transition is harmonic in that all overtones are integer multiples ("harmonics") of the fundamental frequency. Synthesis of the musical sound can loop on the first loop $L_1$ as long as desired. When appropriate, the synthesizing process can move to the second loop $L_2$ through a first amplitude transition. To move from $L_1$ to $L_2$, a sequence of samples are inserted that fill the discontinuity by allowing decay of the harmonics from the amplitudes in the first loop to the amplitudes of the following loop. Preferably, this is done according to the invention by piecewise linear interpolation of the amplitudes of the harmonics in the frequency domain. Since the frequencies are already harmonic, they are not changed during any amplitude transition. Each amplitude transition takes several windows, as many as needed to eliminate clicks that would be induced due to abrupt amplitude changes. Preferably, the amplitude steps during any amplitude transition would be smaller than about 0.05 decibels to be completely inaudible. In practice, larger amplitude steps can be tolerated when complex waveforms with many significant harmonics are involved. The length of each amplitude transition is, therefore, arbitrary, but will be an integer number of windows and must be chosen to minimize amplitude granularity.

Partitioning the sequence of samples in FIG. 2 into

"windows" is a result of conversion of the time-domain representation of the waveform to a frequency-domain one. As explained below, this conversion employs a discrete Fourier transform. One important relationship in this process is given by equation (1), in which:

$$F_f = \frac{\text{sample rate}}{\text{window size}} \quad (1)$$

In equation (1), the window size in samples can be converted to the time duration of a single period of the fundamental frequency by inverting both sides of the equation. This is significant because the W samples contained in any window, therefore, represent a period of the fundamental frequency. Therefore, the W samples in the Lth window are all that are needed to store a representation of a single period of the fundamental frequency.

Figure 3:
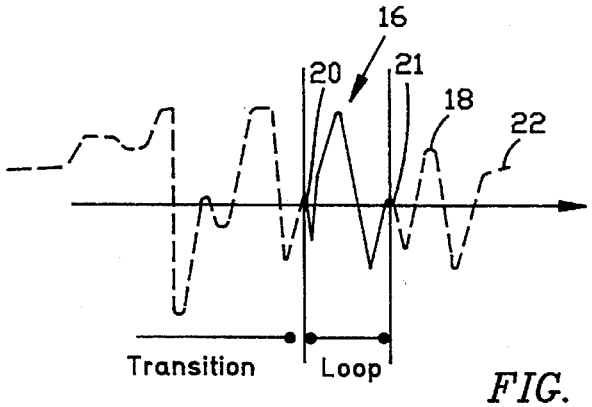
FIG. 3 illustrates how the practice of the invention adjusts the frequency, amplitude, and phase of the spectral components of the waveform of Figure I to produce loop periods of the waveform of FIG. 1 according to the invention.

The significance of the invention with respect to any loop is illustrated in FIG. 3. The explanation following applies as well to any loop in FIGS. 1 and 2. FIG. 3 is a magnified representation of the first cycle 16 of the waveform 10 following the beginning of the first loop portion. Following is a second cycle 18 shown in dotted outline. Looping occurs when the representation of the cycle 16 held in electronic storage is played from point 20 to point 21. Instead of storing representations of cycle 18 and following cycles, the electronic representation of the cycle 16 between points 20 and 21 is continuously repeated ("looped"). Referring again to FIG. 2, a total of W samples is sufficient to store a representation of the loop representing the cycle 16 which can be continuously cycled.

Figure 4:
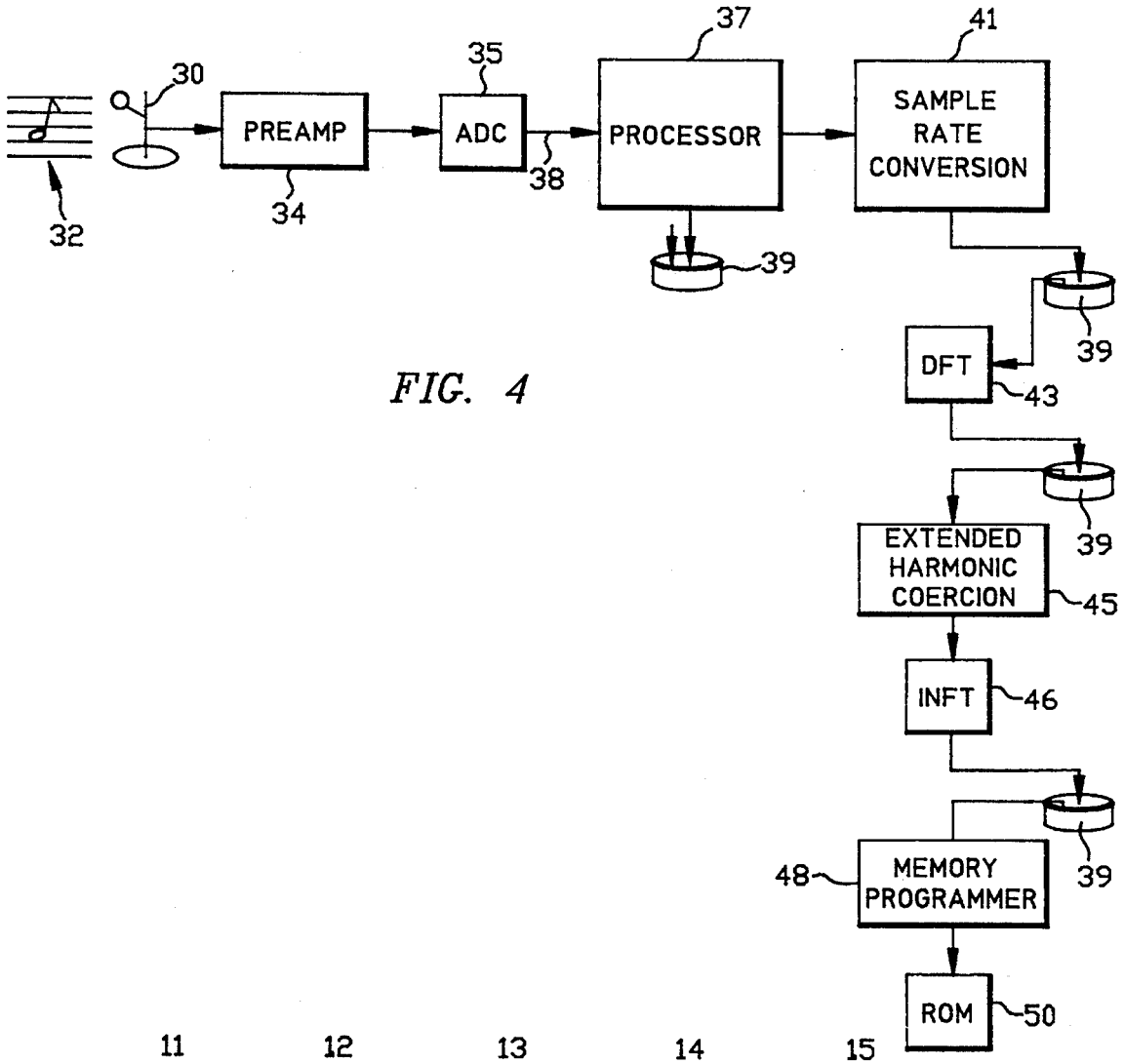
FIG. 4 is a block diagram illustrating a system for producing a stored electronic counterpart of the musical sound according to the invention.

In order to understand the invention, reference is given to FIG. 4 wherein a system for practicing the invention is illustrated.

THE SYSTEM OF THE INVENTION

In FIG. 4, the system for practicing the invention is illustrated and includes a conventional pick-up microphone 30 which is positioned to receive a musical note played, for example, by a piano. The note is represented by the quarter note in the "B" position of the scale fragment 32. As is known, the corresponding key on a piano produces a musical tone having a given fundamental frequency which can be determined by conventional means. The musical tone picked up by the microphone 30 is amplified in an audio passband amplifier 34 and converted from analog to digital form by an analog-to-digital converter (ADC) 35. Preferably, the ADC 35 comprises any conventional converter capable of converting an analog waveform to a sequency of digital samples at a sampling rate sufficient to capture the highest audible harmonic of the musical tone being sampled. For this purpose, the inventors employ an ADC denoted by part number CSZ 5116, available from Crystal Corporation.

As is conventional, the ADC 35 changes the instantaneous amplitude of a waveform produced by the preamp 34 into a digital "word" having a value which represents the instantaneous amplitude. The sequence of digital words output by the ADC 35 forms a sequence of samples representing the musical sound being recorded.

A conventional processor 37 receives at its serial port 38 the sequence of digital words produced by the ADC 35. These words occur at the rate corresponding to the sampling rate. The processor 37, preferably a personal computer of the 486 type, includes a disk storage assembly serviced by a conventional SCSI interface for storing the sample sequence produced by the ADC 35 on a conventional hard disk 39. The processor 37 also includes a CPU which is conventionally programmable to selectively execute application programs in response to prompts, inputs, and commands from a user.

The user blocks 41, 43, 45, and 46 which follow the processor block 7 in FIG. 4 all represent programmed functions which are executed by the processor 37. These functions operate on the sequence of time-domain samples stored on the disk 39, and produce outputs which are, in turn, stored on the disk.

The system blocks 41, 43, and 46 comprise known processing programs which are generally available. The extended harmonic coercion element 45 has been invented in order to realize the objectives and advantages stated above.

Initially, the sequence of time-domain samples is subjected to a sample rate conversion process 41. Sample rate conversion is a well-known technique which can adjust or convert the sampling rate of a data sequence by a ratio of arbitrary positive integers. In this regard, see the article entitled "A General Program to Perform Sample Rate Conversion of Data by Rational Ratios" by R.E. Crochiere in the work entitled PROGRAMS FOR DIGITAL SIGNAL PROCESSING, edited by the Digital Signal Processing Committee of the IEEE Acoustics, Speech, and Signal Processing Society, and published by the IEEE Press in 1979. The sample rate conversion function 41 is invoked to operate on the time-domain samples stored on the disk 39. The purpose of the conversion function 41 is to adjust the number of samples in order to change the sampling rate for a purpose described below. The output of the sample rate conversion 41 is placed on the disk 39, via the disk storage assembly of the processor 37. The output of the conversion 41 is again a sequence of time-domain samples which define the waveform represented by the original, unconverted sample sequence.

The sample sequence output by the conversion function 41 is next subjected to a conventional, discrete Fourier transform, represented by block 43 in FIG. 4. Preferably, the DFT function 43 includes a mixed-radix fast Fourier transform of the type described in the article by Singleton entitled "Mixed-Radix Fast Fourier Transforms", in the PROGRAMS FOR DIGITAL SIGNAL PROCESSING work cited above. The output of the DFT function 43 embraces arrays of digitally-represented values which are stored, once again, on the disk 39.

The output of the DFT function 43 is operated on by a component of the invention termed the "extended harmonic coercion" function 45 which adjusts, first, the frequencies, and then, the amplitudes of the spectral components of the sample musical tone, which components are produced by the DFT function 43. In the preferred embodiment and best mode of the invention, the results of the extended harmonic coercion function 45 are provided immediately to the inverse of the discrete Fourier transform embodied in DFT function 43. This inverse transform (invDFT) 46 produces a sequence of time-domain samples which are stored on the disk 39.

The output of the invDFT function 46 is a sample sequence which corresponds to the attack, transition, and loop portions of the sample sequence of FIG. 2. This sequence is input to a conventional memory programmer 48 which programs the sequence into a memory device such as a read-only memory. For example, the ROM 50 is programmed with the sample sequence stored on the disk 39 by the invDFT 46.

In order to understand the extended harmonic coercion function 45, consider first the sample rate conversion and DFT functions 41 and 43. Initially, the sequence of time-domain samples produced by the ADC 35 is stored on disk 39. The sampling rate of the ADC 35 is high enough to ensure that the highest audible harmonic of the sample waveform is present. (Knowing the fundamental frequency of the waveform, it is possible to either empirically or by analysis determine the highest audible harmonic.) With the sample rate and fundamental frequency $F_f$, equation (1) can be employed to determine the window size which, as will be recalled, is equal to the product of the fundamental period of $F_f$ and the sampling rate. The sample rate conversion function 41 is invoked to manipulate the number of samples for the purpose of adjusting the sample rate to a value which will make the window size in number of samples an even integer. When the window size is an even integer, operation of the DFT on each window will produce a number of frequency bins which is exactly one-half of the number of samples in a window. Since the sample rate conversion function 41 is employed to make window size an even integer number of samples, the number of frequency bins resulting from the DFT function 43 will be an integer. Those familiar with the operation of an DFT will realize that each bin of the function represents a frequency which is an integer multiple of the fundamental frequency $f_f$.

The performance of the sample rate conversion function 41 is critical to the practice of the invention as it allows the placement of the fundamental frequency $F_f$ in exactly one frequency bin following application of the DFT function 43. Furthermore, if the most noticeable (highest amplitude) harmonic is harmonic number M, exactly M periods of that harmonic will fill one window. Finally, harmonic number M and every other component frequency of the waveform that is harmonic with the fundamental frequency $F_f$ will also fall in exactly one frequency bin of the DFT function 43.

With reference to Tables I and II, the extended harmonic coercion function 45 will now be explained. In Table I, a plurality of arrays are defined. Array I(n) represents the sample sequence stored on the disk 39 after sample rate conversion, and just prior to application of DFT function 43. The product of the invDFT function 46 is an output sequence O(n) of time-domain samples. The DFT function 43 conventionally outputs real and imaginary components, RE and IM, which are indexed by sample sequence window and harmonic number. Thus, for each successive window in the input sequence I(n), the DFT function 43 will output M pairs of real and imaginary components. The phase components operated on by the harmonic coercion function are denoted by IP and include M components for each window of the input sequence. Output phase components are denoted by the array OP. A total of M amplitude and frequency components are produced by conversion of the real and imaginary components output by the DFT. The frequency components F are operated on by the extended harmonic coercion function 45. Thus, for each window $w_i$ of the input sequence, exactly M frequency components will be produced, each having an associated amplitude component A.

The arrays defined above are indexed and bounded by the values given in Table I. In this regard, N is the length of an input or output sequence in number of samples. For example, referring back to FIG. 2, the illustrated sequence has N amplitude samples, numbered from 1 through N. In the invention, sample number $T_1$ specifies the start of the frequency transition portion of the sequence, while sample $L_1$ denotes the start of the first loop sequence. The sample numbers are non-specific in FIG. 2. For each musical sound subjected to the invention, the values for these parameters are either known or are determined experimentally prior to the operation of the invention; when determined, they are entered into the processor 37. For each fundamental frequency $F_f$, the number W of samples in one analysis window will vary from one recording to another. Sine the sample rate conversion function 41 results in a window size W that is an even integer, the parameter M (the number of significant harmonics yielded by the DFT function 43) will be an integer equal to W/2.

Generally, the DFT function 43 yields the real and imaginary arrays for each analysis window. As those skilled in the art will appreciate, the DFT function 43 shifts the sample sequence from the time to the frequency domain. The inverse function of, the DFT conventionally transforms the real and imaginary frequency-domain arrays into the output time-domain sequence O.

Table II is a pseudocode representation of the extended harmonic coercion function. It provides the basis for writing an application program in any language supported by the processor 37. In Table II, it is assumed that the input sequence I(N) has been sample-rate-converted as described above so that it consists of N samples over which N/W consecutive windows are defined, where each window spans W samples. The output of the DFT function 43 is the array of real and imaginary value RE(N/W,M) and IM(N/W,M), respectively. These arrays are stored on the disk 39.

The extended harmonic coercion function 45 converts the real and imaginary arrays to amplitude and frequency values. This is done in step 2 of the process of Table II. First, an input phase array IP(w,m) is calculated, a phase difference is calculated and normalized, and frequency and amplitude components are thereafter derived for each window according to the equations in step 2. In this step, the sampling rate is the rate resulting from the sample rate conversion function 41. Utilization of the phase difference value in the frequency calculation of step 2 preserves the phase information inherent in the sampled waveform.

Recalling that the attack portion of the input sequence extends from window O to window (T/W)−1, step 3 of the Table II procedure uses the input amplitude and frequency values for these windows to calculate the real and imaginary components of the attack portion. These are Converted by the inverse discrete Fourier transform function 46 back into time-domain values. Thus, the attack portion of the sampled waveform is unchanged from its original form. It is observed that the output phase array OP(n) used in the calculation of the real and imaginary component arrays for the attack portion is initialized for W=0 by setting OP(w−1 ,m) equal to IP(O,m).

Figure 5A:
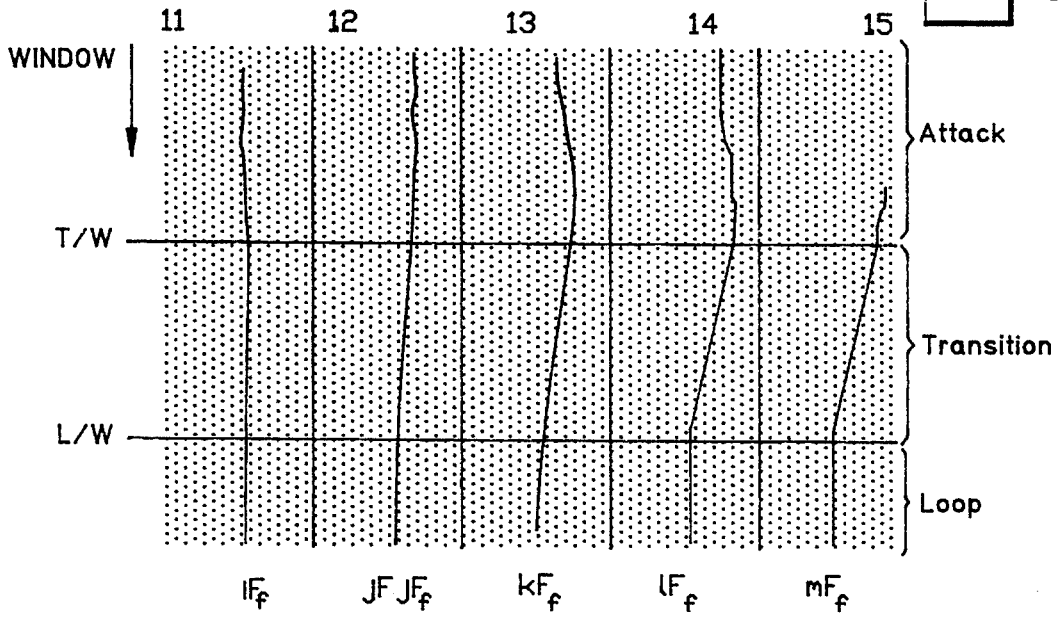
FIG. 5A is a frequency-domain plot illustrating how frequency components of the waveform of FIG. 1 are coerced according to the invention.
Figure 5B:
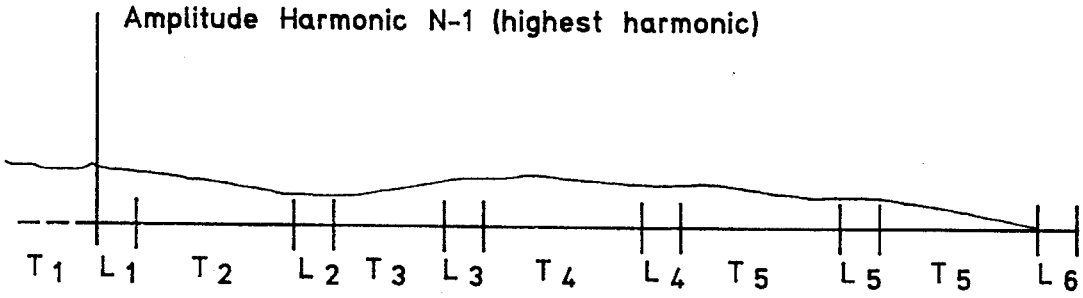
FIGS. 5B–5E is a time-domain plot illustrating how harmonic amplitudes of the waveform of FIG. 1 are manipulated after harmonic coercion.
Figure 5C:
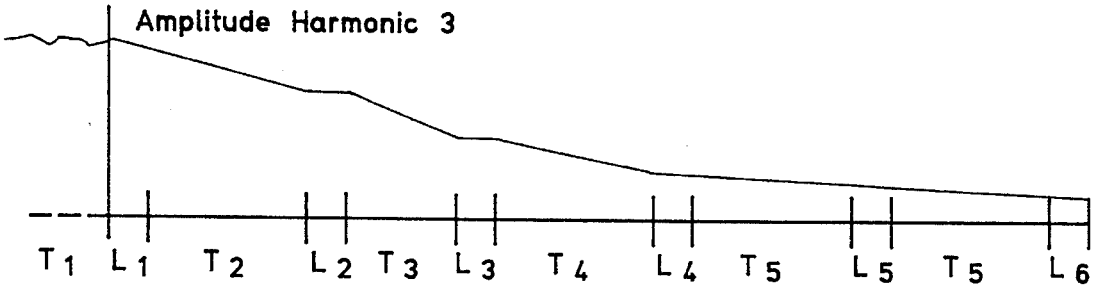
Figure 5D:
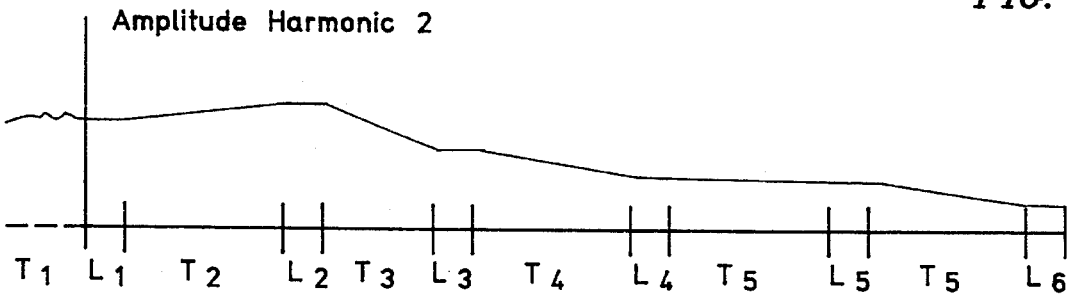
Figure 5E:
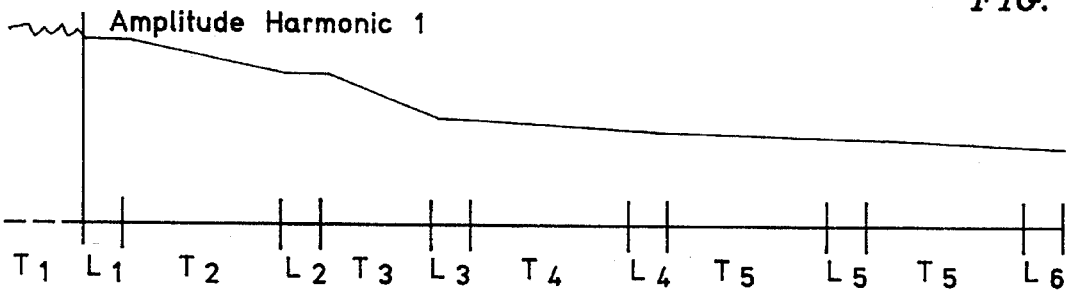

In step 4, the frequencies F which are produced according to conversion step 2 of Table II are changed, window-by-window to be harmonics of (that is, integer multiples of) the fundamental frequency $F_f$. This is accomplished, for each frequency, by straight linear interpolation from the frequency value which the frequency has at the beginning of the transition portion to the center value of its associated bin by the end of the transition portion. This is illustrated in FIG. 5A where bins 11, 12, 13, 14, and 15 of the DFT function 43 are illustrated. As is conventional with an DFT, "bins" are utilized to separate the frequency components produced by conversion of the real and imaginary outputs of the DFT. In actuality, each bin represents a range of frequencies centered on a "bin frequency". The widths of the bins are equal, and the number of bins is determined by the window size as explained above. This is illustrated in FIG. 5A which is separated horizontally into bins, each bin having a respective harmonic number corresponding to one of the M frequencies yielded by the DFT function. In FIG. 5A, the vertical dimension corresponds to window numbers so that for each window, conversion of the real and imaginary outputs yields M frequency values. During the attack portion, these frequency values exhibit variance from the center frequencies of their respective bins. Such variance can be considerable as illustrated, for example, by the spread of frequency values in the attack portion of the fifteenth frequency bin.

In the frequency transition portion of FIG. 5A, it will be appreciated that a continuous straight line adjustment is made in each frequency bin from the last frequency value in the bin for the attack portion to the center frequency value precisely at the boundary between the transition and loop portions. Since each center frequency is exactly an integer multiple of the fundamental frequency, the bin frequencies are true harmonics of the fundamental frequency. For example, the center frequency of the eleventh bin is equal to i $F_f$, where $F_f$ is the fundamental frequency and i is an integer.

Referring now to step 4 of Table II, the processing performed by the extended harmonic coercion function 45 on the frequency transition portion of the input sequence is described. First the length of the frequency transition portion in windows is calculated, the value being equated with the parameter $T_{13}$ LENGTH. Now, for each window in the transition portion that is window T/W, which abuts the boundary between the attack and the frequency transition portions, through window (L/W)-I which abuts the boundary between the frequency transition and first loop portions, the frequency value is adjusted by the slope value (position) obtained by dividing the length of the frequency transition portion into the difference in windows between the current window and the first window of the frequency transition period, that is, window T/W. The position value is used to adjust the value of the frequency for the Current window according to the equation for F(w,m) given in step 4. Once the array of frequency values for each window in the transition portion has been adjusted to force each frequency to a value which is an integer multiple of the fundamental frequency, the real and imaginary components for the frequency transition portion are recalculated using the adjusted values in the frequency array. It is observed that the amplitude values in the attack and frequency transition portions are unaffected, the sole objective being to force the component frequencies to be harmonics of the fundamental frequency. Using the adjusted real and imaginary values, step 4 ends by subjecting the values to the inverse discrete Fourier transform and appending the derived sample values at the end of the output array.

In step 5 of Table II, frequency values are not obtained from the array F(w,m). Instead, the frequency values obtaining at the end of the frequency transition portion are utilized. For each bin frequency, this value is obtained by multiplying the bin number m by the sampling rate and dividing the product by the window size W. Step 5 ensures that the phase transition for each frequency from the transition to the loop portion is continuous by picking up the output phase array OP where ended in the transition portion. Then, the real and imaginary components for the single loop window L/W are calculated and subjected to the inverse transform to produce W time-domain samples which are appended to the output array.

In step 6, the beginning and ending times for subsequent amplitude transitions and loops are established. Note that the frequency values obtaining at the end of the frequency transition portion (step 4) are utilized. Representative windows are established and amplitudes (A) for the component frequencies are calculated. In step 7, using the frequencies from step 5 and the related amplitude values from step 6, the amplitude change for each frequency over the particular amplitude transition portion is calculated for each window in the transition portion. The array of amplitude increments for each frequency in the transition portion is built, followed by phase normalization and inverse DFT calculation. Each time step 7 is executed, it is followed by step 8, which builds a loop terminating the amplitude transition portion.

Refer now to FIGS. 5B–5E which show amplitude plots for four harmonics over a sequence of amplitude transition/loop bursts. In each case, the amplitude of the harmonic is plotted versus time after completion of frequency coercion in the frequency transition $T_1$. The first loop is denoted by $L_1$, the first amplitude transition by $T_2$, and so on. As FIGS. 5B–5E illustrate, during the loop portions, the amplitude and frequency of each harmonic remain the same. However, during the amplitude transitions, the amplitude is changed from a first value at the end of a loop to a second value at the beginning of the following loop. The amplitude may decline as with harmonic 1, or increase as with harmonic 2 in the amplitude transition portion from $L_1$ to $L_2$.

As implied by step 9 of Table II, the number of amplitude transition/loop bursts (steps 7 and 8) may be repeated as many times as necessary.

Figure 6:
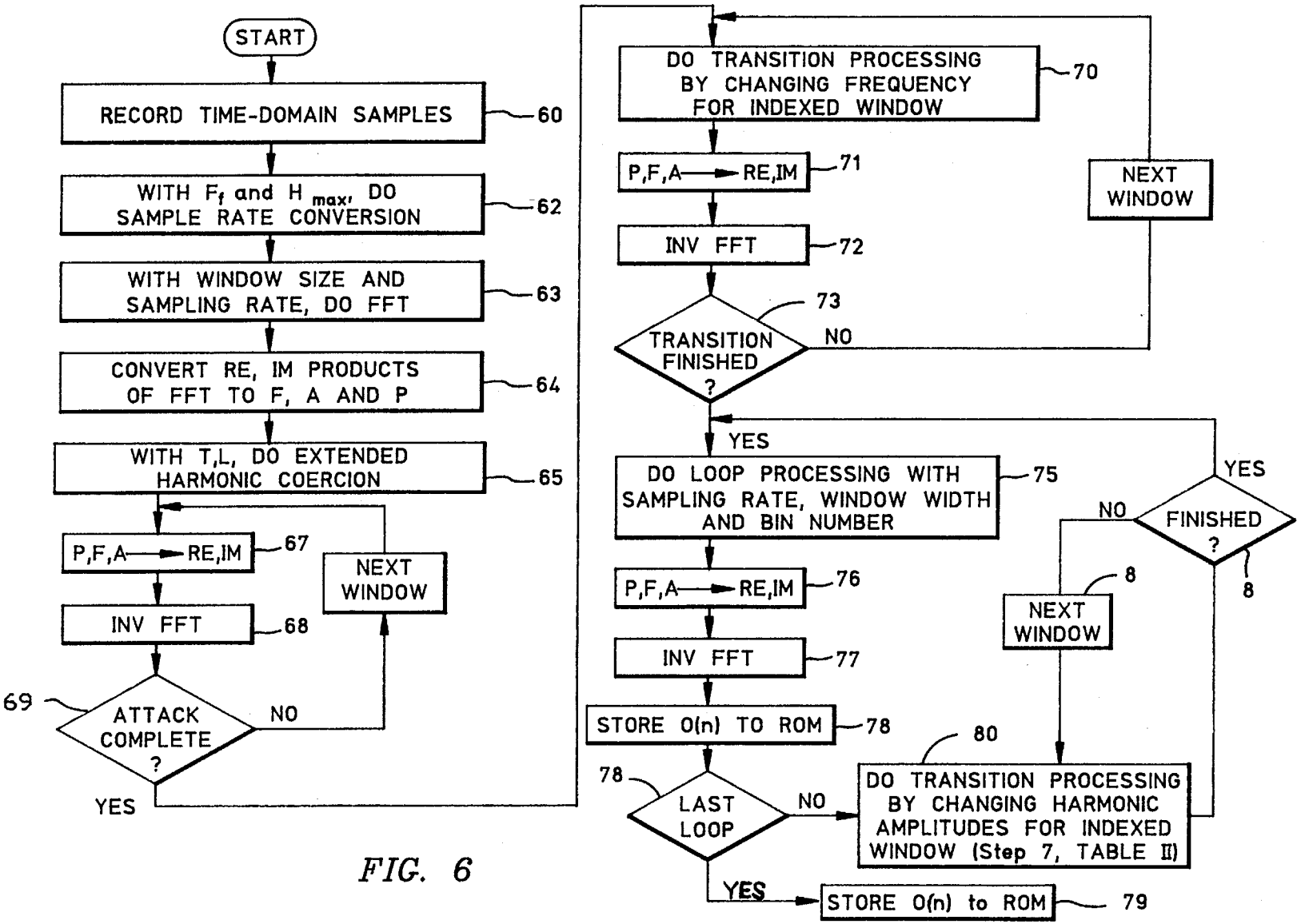
FIG. 6 is a process flow diagram illustrating the method embodied in the system of FIG. 4.

The operation of the method of the invention is illustrated in a flow diagram in FIG. 6. All operations are performed by the processor 37 of FIG. 4 under control of an operator.

In FIG. 6, the method of the invention includes recording the sequence of time-domain waveform samples prior to sample rate conversion. This is step 60. Next, in step 62, knowing the fundamental frequency $F_f$ and the highest audible harmonic ($H_{max}$), sample rate conversion is performed in order to make the window size an even integer while keeping the converted sample rate high enough to capture $H_{max}$. In step 63, having adjusted the sampling rate to achieve the desired window size, the time-domain sequence is converted to frequency-domain arrays of real and imaginary values by the DFT.

Next, in step 64, the real and imaginary products of the DFT are converted to frequency (F), amplitude (A), and phase (P) arrays in accordance with step 2 of Table II. Next, in step 65, the transition and loop portions are defined by identification of sample T and sample L. Preferably, these values are input by operator action via the processor 37. With these inputs, the harmonic coercion function 45 is invoked.

In accordance with step 3 of Table II, the attack portion of the waveform is converted back into an output sequence of time-domain samples O(n) in steps 67, 68, and 69. Step 69 indexes on the window numbers in the attack portion, which extends from window $w_0$ to window $W(T/w)_{-1}$. For each window, the real and imaginary components for each of the M frequencies are calculated in step 67 and combined by the inverse DFT in step 68 to yield time-domain values which form the attack portion of the output array O(n). When the time-domain values have been recalculated for the attack portion, the positive exit is taken from decision 69 and frequency transition processing is begun in step 70.

Steps 70, 71, 72, and 73 perform frequency transition processing, indexing on each window of the frequency transition portion and, during each window, on each of the M component frequencies. Thus, for each window, step 70, by linear interpolation, changes each component frequency from its value at the beginning of the transition to a new value for the indexed window. Of course, when the indexed window is the last one in the transition, that is window $W_{(L/W)-1}$, each frequency value will be almost an integer multiple of the fundamental frequency. In steps 71 and 72, the phase, frequency, and amplitude values for the window are converted to real and imaginary values and then to time-domain values. The set of time-domain samples for the indexed window are then appended to the output array O(n). When the time-domain samples for the last window of the transition portion have been appended to the output array, the positive exit is followed from decision 73 and loop processing is executed.

In loop processing corresponding to step 5 of Table II, all of the component frequencies available for inverse Fourier processing are now harmonic with the fundamental frequency. Thus, preparation of a window-wide set of time-domain samples can be accomplished by steps 75–77. In step 75, the sampling rate, window width, and DFT bin number are used for each component frequency to obtain the frequency's value. Using the set of frequencies calculated in step 75 for the window, step 76 calculates the real and imaginary components for the frequencies from the phase, frequency, and amplitude arrays for the window. The inverse DFT is invoked in step 76 to produce the time-domain samples, which are appended to the output array On.

When the first loop has been constructed by processing according to steps 75–77, decision 78 checks to see whether all of the desired loops have been constructed. Since more than one loop is contemplated by this invention, after construction of the first loop, the negative exit will be taken from the decision 78 and the first amplitude transition portion will be constructed in step 80. In step 80, the number of windows necessary for the amplitude transition portion is established, and amplitude processing is performed on each of the harmonic frequencies by interpolation over the number of windows in the transition from a value in the previous loop to a desired value in the next loop. The frequencies are adjusted window-by-window through steps 80, 81, 82 until the last window of the transition portion has been reached and the positive exit is taken from decision 81. Following exit from the transition processing sequence 80, 81, 82, the next loop is constructed by steps 75–77, and the process continues until the last loop is encountered, at which time the positive exit is taken from decision 78 and the output array is transferred to the disk 39.

Figure 7:
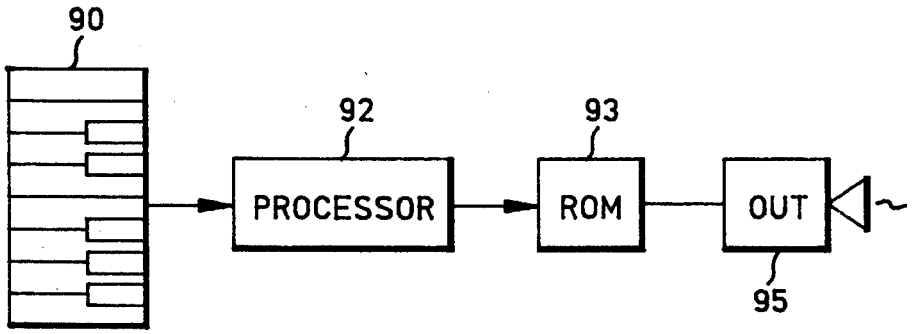
FIG. 7 is a block diagram illustrating an operative environment in which an electronic counterpart of a musical sound produced according to the invention is employed in an electronic instrument.
Figure 8:
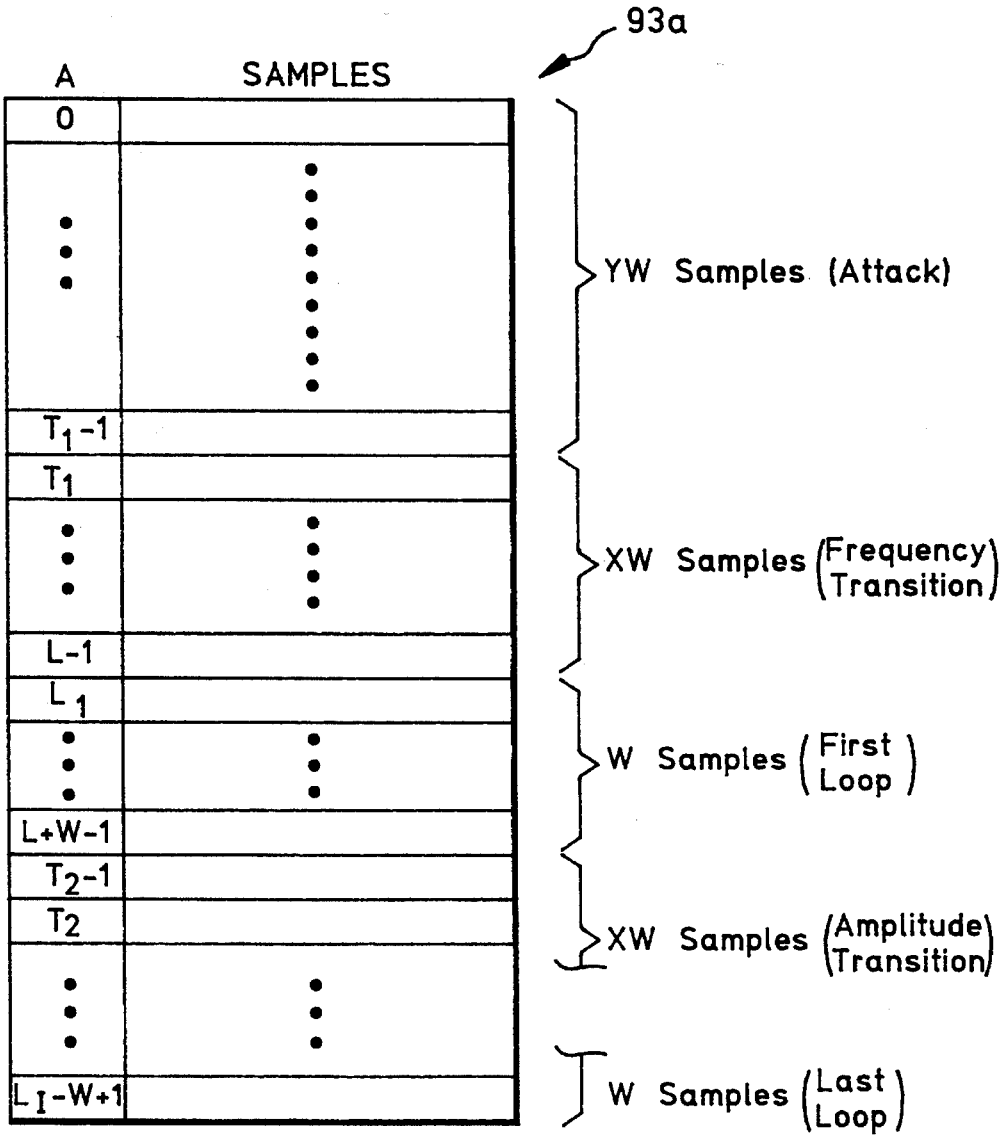
FIG. 8 is a memory map illustrating how a sequence of time domain samples subjected to the process of the invention are stored in the memory of FIG. 7.
Figure 9:
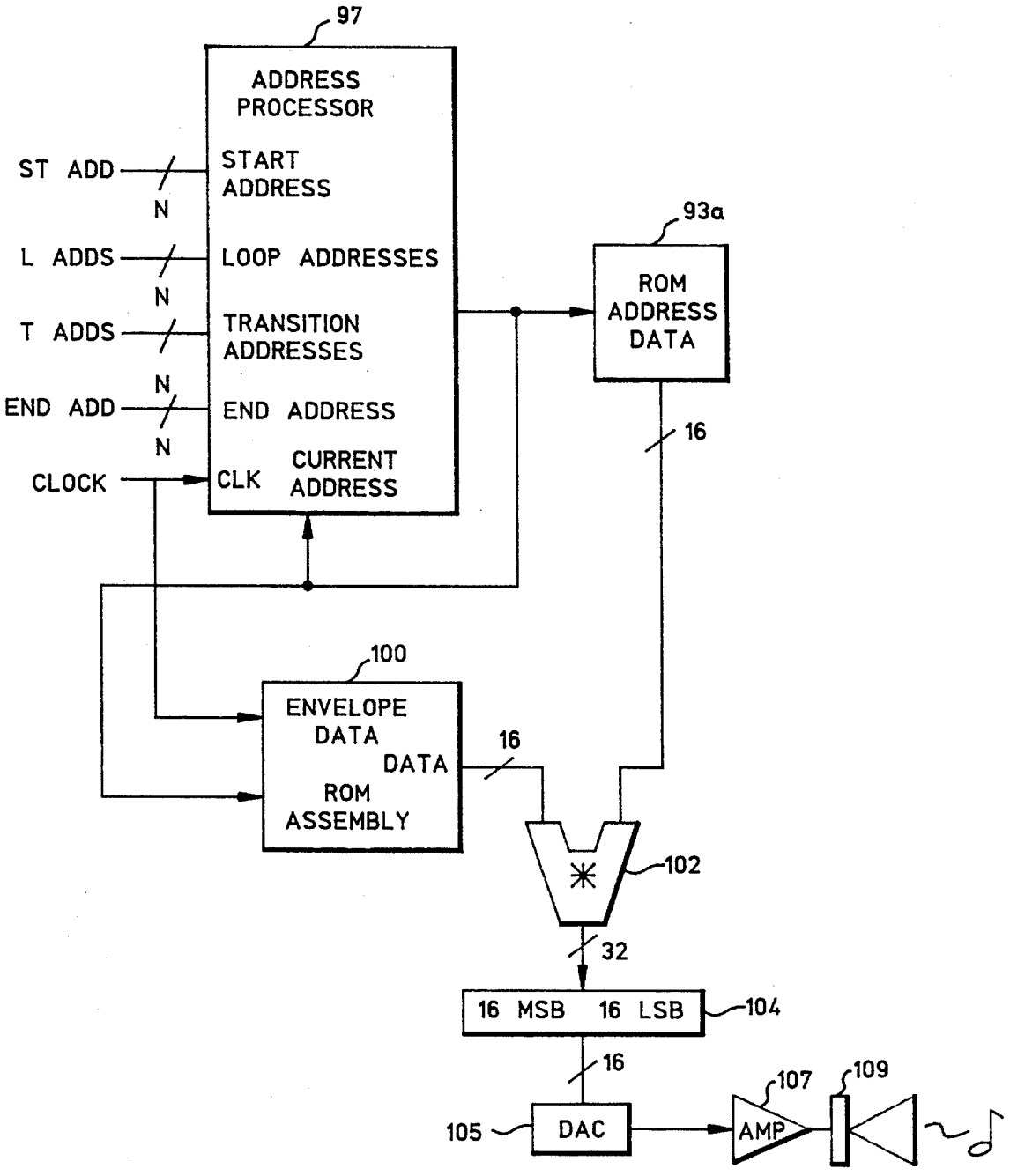
FIG. 9 is a block diagram illustrating in greater detail certain components of the system of FIG. 7.

FIGS. 7–9 illustrate use of an output array comprising a sequence of time-domain samples processed according to the technique laid out above. In FIG. 7, the electronic instrument can include a keyboard 90 connected to a processor 92 which controls a ROM array 93. The keyboard 90 is operated in a conventional manner and includes an interface which converts playing of the keyboard into a set of signals. The signals are received by the processor 92 which, in response, accesses musical tone counterparts stored in the ROM array 93. Each stored sequence corresponds to a respective key of the keyboard. When a key is selected (played), the processor accesses the ROM to read out the corresponding sequence. The musical tone representations are time-domain sample sequences containing attack, transition, and loop sections as described above. When a sequence is read out of the ROM; it is passed to an output apparatus 95. The output apparatus converts the digital time-domain samples read, from the ROM array 93 to analog form, amplifies them, and provides them to a speaker which generates an audible output in response.

FIG. 8 represents a memory map for a sequence of time-domain samples which have been processed according to FIG. 6. In particular, FIG. 8 represents a ROM sector in which a sequence like that in Figure 2 is stored. In this regard, a ROM sector **93*a* includes storage space to store the sequence of time-domain samples at addressable locations 0** through N–1. The first T samples comprise the attack section and are stored at address locations O through T–1. The frequency transition section samples are stored at address, locations T through L–1 and include samples which have been harmonically coerced according to the technique described above. Next, the sequence of samples representing the first loop section of the overall sequence stored at address location L through L+W–1. In keeping with the description above, the first loop section can include as few as W samples which is a sufficient number to represent a single period of the fundamental frequency.

Following the first W samples representing the first loop, a number of amplitude transition/loop bursts are stored in which each amplitude transition section includes samples stored at address locations and which represent harmonics whose amplitudes have been coerced according to the technique described above. Following each amplitude transition section is a loop section stored at a particular sequence of address locations.

FIG. 9 illustrates in greater detail the elements of FIG. 7 which are necessary to play back the musical sound whose counterpart is stored in the ROM **93*a* of FIG. 8. In this regard, it is asserted that the processor 92 includes a conventional address processor 97 which outputs a sequence of addresses on a connection to the address port of the ROM 93*a*. In response to addresses provided at the address port of ROM 93*a*, the time-domain samples are provided at the data port of the ROM. The data port of the ROM 93*a* is fed to one input of the conventional digital multiplier 102 which receives, at its other input, envelope data from an envelope data assembly 100**.

Assuming that the samples in the ROM **93*a* are represented by 16-bit words, the envelope data will also be in 16-bit form and the multiplier 102 will produce a 32-bit product which is truncated at register 104 to the most significant 16 bits. These 16 bits are fed to a digital-to-analog converter (DAC) 105 which converts the sequence of products into a continuous analog output amplified at 107. The amplified output is fed to a speaker at 109** which generates the musical sound with an appropriate attenuation envelope.

Assume now that the key on the keyboard 90 corresponding to the musical sound stored in the ROM sector **93*a* is selected. In this case, the processor 92 identifies the ROM 93*a* and provides to the address processor 97 a start address, transition and loop addresses, and an end address. The processor 92 also provides a clock waveform to the address processor 97. In response to these inputs, the address processor generates a sequence of addresses at the clock rate. The sequence begins at the start address which corresponds to address O in FIG. 8** and then generates the sequence of addresses from the start address to the last loop address $L_l$. Once the address processor reaches the last loop address, it enters a loop mode in which it cycles from the last loop address, $L_l$, to the end address $L_{l+}W-1$. Once the end address is reached, the address processor begins the last loop cycle again from the last loop address, and so on.

The amplitude envelope data assembly 100 is operated synchronously with the address processor 907 by provision of the same clock signal. The operation of the envelope data assembly 100 is represented by the process described in Table III. In Table III, the index n corresponds to the address sequence output by the address processor 97. The assembly provides data which is described by the parameters g and r in Table III. In this regard, for so long as the ROM 93*a* is being addressed sequentially through the attack and transition portions of the stored representation, the gain factor provided from the assembly 100 is unity. When the loop portion of the ROM 93*a* is addressed, the gain factor is reduced incrementally each time the loop in the ROM 93*a* is begun. For each traversal of the loop, the gain factor is decremented by the amplitude ramp factor r for so long as the loop is traversed. This will impose a constant attenuation on the amplitude of the musical sound produced at 109.

The skilled practitioner will appreciate that the gain can be changed at any sample of the loop as needed.

TABLE I

| Definitions: | |
|---|---|
| Arrays: | |
| I(n) | Input sequence that represents a recorded sound in which one period of the fundamental frequency is exactly W samples. |
| O(n) | Output sequence (the result of the method shown here). |
| RE(w,m) | The real components of the DFT output. |
| IM(w,m) | The imaginary components of the DFT output. |
| IP(w,m) | The original input phase components (used in intermediate calculations). |
| OP(w,m) | The output phase components (also used in intermediate calculations). |
| A(w,m) | Amplitude components. |
| F(w,m) | Frequency components. |
| Array indices and boundaries | |
| N | The number of samples in (or length of sequences I and O. |
| n | Sample index. |
| T | The sample number that specifies the start of the transition segment. |
| L | The sample number that specifies the start of the loop segment. The sample times N, T, and L are arbitrary, are determined experimentally, and will vary from one recording to another. |
| W | Number of samples in one analysis window, the length of the fundamental period. |
| w | Window number index. |
| M | The number of significant harmonics yielded by the DFT. The quantity M depends on window size W (the size of the fundamental period). |
| m | Harmonic number index. |
| Transforms: | |
| DFT{} | is a discrete Fourier transform that yields two arrays, real RE and imaginary IM, for each analysis window. This provides the shift from the time domain to the frequency domain. The window size is chosen so that an integer number of periods fall within the window. |
| invDFT{} | is an inverse discrete Fourier transform that transforms the two frequency-domain arrays, real RE and imaginary IM, into the time-domain array o. |

TABLE II

| Sequence preparation |
|---|
| 1. Convert the entire time-domain sequence to the frequence domain. |
| for n=0 to N |
| DFT{I(N)} → RE(N/W,M) and IM(N/W,M) |
| 2. Convert RE(w,m) and IM(w,m) to A(w,m) and F(w,m) |
| for w=0 to N/W |
| for m=0 to M |
| IP(w,m) = arctangent {IM(w,m) / RE(w,m)} |
| phase difference = IP(w,m) − IP(w−1,m) |
| normalize phase_difference to fall in the range −π to π |
| F(w,m) = sampling rate · (phase-difference/2π + m/W) |
| A(w,m) = square_root{RE(w,m) · RE(w,m) + IM(w,m) · IM(w,m)} |
| 3. Attack portion. Use input amplitudes and frequencies. |
| for w=0 to (T/W)−1 |
| for M=0 to M |
| OP(w,m) = OP(w−1,m) + (F(w,m) − (n/W)) · 2π / sampling rate |
| normalize OP (w,m) to fall in the range 0 to 2π |
| RE(w,m) = A(w,m) · cos{OP(w,m)} |

TABLE II-continued

| Sequence preparation |
|---|
| IM(w,m) = A(w,m) · sin{OP(w,m)} |
| invDFT{RE(w,M), IM(w,M)}→ O(n) |
| 4. Transition portion. Gradually coerce frequencies to be harmonic. Use input amplitudes. |
| T-LENGTH = 1 + L/W − T/W, the length of the transition (in windows) |
| for w=T/W to (L/W)−1 |
| position = (w−T/W / T_LENGTH |
| F(w,m) = (F(T,m) · (1 − position)) + (position · m · sampling rate / W) |
| for m = 0 to M |
| OP(w,m) = OP(w−1,m) + (F(w,m) − (n/W)) · 2π/sampling rate |
| normalize OP(w,m) to fall in the range 0 to 2π |
| RE(w,m) = A(w,m) · cos{OP(w,m)} |
| IM(w,m) = A(w,m) · sin{OP(w,m)} |
| invDFT{RE(w,M), IM(w,M)} → O(n) |
| 5. First loop portion. Freeze amplitudes and frequencies (now harmonic). |
| W=(LW) |
| F(w,m) = m · sampling rate /W |
| OP(w,m = OP(w−1,m) + (F(w,m) − (n/W)) · 2π/sampling rate |
| normalize OP(w,m) to fall in the range 0 to 2π |
| RE(w,m) = A(w,m) · cos{OP(w,m)} |
| IM(w,m) = A(w,m) · sin{OP(w,m)} |
| invDFT{RE(w,M), IM(w,M)} → O(n) |
| 6. Set up subsequent transition and loop times. Frequencies are still frozen and remain harmonic. Choose several representative windows spaced some distance apart in time and record for use in Step 7 their amplitudes: A(w,m)=square_root{RE(w,m)·RE(w,m)+ IM(w,m)·IM(w,m)} |
| 7. Amplitude transition portion. Use frequencies from step 5. |
| T_LENGTH=1+L2/W−T2/W, the length of the transition (in windows) |
| for w=T2/W to L2/W−1 |
| position=(w−T2/W)/T_LENGTH |
| A(w,m)=A(L1,m)·(1-position)−position·A(L2,m) |
| F(w,m)=m·sampling_rate/W [this is the same as in step 5] |
| [as in step 4, calculate and normalize phase, RE, IM and do invDFT] |
| 8. Subsequent loops. These are essentially the same as step 5 except that frequencies are already harmonic. |
| 9. Repeat steps 7 and 8 as many times as needed. |

TABLE III

| Playback of sequence (simplified): |
|---|
| g gain factor |
| r amplitude ramp factor = 1 / (decay time in seconds · sampling rate) |
| DAC digital to analog converter |
| for n − 0 to L−1 |
| O(n) → DACA |
| g = 1 |
| while g > 0 |
| for n = L to N−1 |
| g · O(n) → DAC |
| g = g − r |

While we have described several preferred embodiments of our invention, it should be understood that modifications and adaptations thereof will occur to persons skilled in the art. For example, the best mode and preferred embodiment of the invention include using the phase component in the harmonic coercion function. However, the inventors contemplate an embodiment that does not incorporate or utilize the phase component in harmonic coercion. Therefore, the protection afforded the invention should only be limited in accordance with the scope of the following claims.

We claim:

1. A method of creating and preserving a counterpart of a sound having a fundamental frequency, the method utilizing a memory device and comprising the steps of:

generating a sequence of original time domain samples of the sound, the sequence including successive adjacent portions in which a first portion exhibits aperiodic fluctuations of amplitude of the sound, a second portion, following the first portion, exhibits decreasing aperiodic fluctuations of amplitude of sound, and a third portion, following the second portion, exhibits substantially periodic fluctuations of amplitude of the sound;

transforming the sequence of original time domain samples to frequency domain values including a set of frequency values representing component frequencies of the sound, the frequency domain values including the fundamental frequency and a plurality of related frequencies;

from the beginning of the second portion, changing the related frequencies in the set of frequency values such that the related frequencies are substantially integral multiples of the fundamental frequency by the end of the second portion;

from the beginning of a first loop portion, maintaining the related frequencies in the set of frequency values as substantially integral multiples of the fundamental frequency for a time substantially corresponding to one period of the fundamental frequency;

from the beginning of a fourth portion following the first loop portion, changing amplitudes of the related frequencies in the set of frequency values;

from an end of the fourth portion, maintaining the amplitudes and frequencies of the related frequencies in the set of frequencies for a time substantially corresponding to one period of the fundamental frequency; and transforming the frequency domain values to a sequence of adjusted time domain values and storing the sequence of adjusted time domain values in the memory device.

2. A method for synthesizing sound made by a musical instrument, comprising the steps of:

generating a plurality of amplitude samples of the sound;

partitioning the plurality of amplitude samples into successive adjacent attack, frequency transition, first loop, amplitude transition, and second loop portions, wherein:

in the attack portion, the amplitude samples display aperiodic fluctuations in the amplitude of the sound;

in the frequency transition portion, the amplitude samples display decreasing aperiodic fluctuations of the amplitude of the sound;

in the first loop portion, amplitude transition portion, and second loop portion, the amplitude samples display substantially periodic fluctuation of the amplitude of the sound;

transforming the amplitude samples of the frequency transition portion into frequency and amplitude components of the sound, the frequency components including a fundamental frequency component and a plurality of related frequency components;

from the end of the attack portion until the beginning of the first loop portion, substantially continuously adjusting the value of each of said related frequency components over the length of the frequency transition portion such that each of said related frequency components has substantially an integer ratio to the fundamental frequency by the beginning of the first loop portion;

from the beginning of the first loop portion until the end of the first loop portion, maintaining the frequency and amplitude of each of said related frequency components over the length of the first loop portion, the length of the first loop portion corresponding essentially to one period of the fundamental frequency;

from the beginning of the amplitude transition portion until the beginning of the second loop portion, substantially continuously adjusting the amplitude of each of said related frequency components over the length of the amplitude transition portion;

from the beginning of the second loop portion until the end of the second loop portion, maintaining the frequency and amplitude of each of said related frequency components, the length of the second loop portion corresponding substantially to a period of the fundamental frequency; and transforming the frequency and amplitude components of the attack, first transition, first loop, second transition, and second loop portions back to amplitude values.

3. The method of claim 2, further including, for each loop portion, generating frequency and amplitude components of the sound for at least one period of the fundamental frequency, the frequency components including the fundamental frequency and the related frequency components, each of the related frequency components having substantially an integer ratio to the fundamental frequency, the frequency components of the first and second loop portions having phase continuity with the frequency components of the first and second transition portions, respectively.

4. In an apparatus for synthesizing musical notes in response to selection of keys on a keyboard, a combination comprising:

key conversion means for generating a sequence of address signals which corresponds to a selected key;

storage means connected to the key conversion means and containing stored amplitude signals at addressable storage locations for providing a sequence of amplitude signals representing a musical note corresponding to the selected key in response to the sequence of address signals, wherein:

the sequence of amplitude signals representing the amplitude of the musical note and including an attack portion in which the amplitude of the musical note exhibits aperiodic fluctuations, a first transition portion wherein the amplitude of the musical note exhibits decreasing aperiodic fluctuations, a first loop portion in which the amplitude of the musical note exhibits substantially periodic fluctuations, a second transition portion and a second loop portion;

the sequence of amplitude signals including a set of frequency components with a fundamental frequency and a plurality of related frequencies wherein the related frequencies in the first transition portion of the sequence of amplitude signals interpolate from first values to integral multiples of the fundamental frequency; and, wherein the amplitudes of the related frequencies in the second transition portion of the sequence of amplitude signals interpolate from first amplitude values to second amplitude values without changing the frequency values; and output means connected to the storage means for producing an analog counterpart of the musical note in response to the sequence of amplitude signals.

5. An apparatus for transforming musical signals, comprising:

conversion means for converting a musical sound into a sequence of amplitude samples representing change in amplitude of musical sounds over time;

transform means connected to the conversion means for transforming successive, adjacent portions of the sequence of amplitude samples into frequency and amplitude components of musical sound, frequency components including a fundamental frequency in a plurality of related frequencies, the successive, adjacent portions including an attack portion in which the amplitude of the musical sound has aperiodic variations, a first transition portion following the attack portion in which the amplitude of the musical note has decreasing aperiodic variations, a first loop portion following the first transition portion, a plurality of bursts following the first loop portion, each burst including an amplitude transition portion followed by a loop portion;

first means in the transform means for substantially continuously adjusting the value of each of the related frequency components over the amplitude transition portion such that each of the related frequency components is a respective integer multiple of the fundamental frequency;

second means in the transform means for substantially continuously adjusting the value of the amplitude of each of the related frequency components over an amplitude transition portion;

conversion means for converting the frequency and amplitude components back to a sequence of amplitude samples; and means connected to the conversion means for storing a plurality of sequences of amplitude samples, each sequence of amplitude samples corresponding to a respective musical sound.

6. The apparatus of claim 5, wherein the transform means further includes means for maintaining the frequency and amplitude of each of said related frequency components over the length of each loop portion, the length of each loop portion corresponding substantially to one period of the fundamental frequency.

7. The apparatus of claim 5, wherein the transform means further includes means for preserving phase continuity between the frequency components of the attack portion and the frequency components of the transition portion.

8. The apparatus of claim 5, wherein each frequency of the related frequencies has a value at the end of the attack portion, and wherein the first means is further for interpolating values for each related frequency between a value for the related frequency at the end of the attack portion and an integer multiple of the fundamental frequency at the end of the frequency transition portion.

9. The apparatus of claim 5, wherein each frequency of the related frequencies has, for each amplitude transition portion, a value at the beginning of the amplitude transition portion and a value at the end of the amplitude transition portion and wherein the second means is further for interpolating amplitude values for each related frequency between the amplitude value for the related frequency at the beginning of the amplitude transition portion and the amplitude value for the related frequency at the end of the amplitude transition portion.

* * * * *